US005513701A

United States Patent [19]

Burns et al.

[11] Patent Number: 5,513,701

[45] Date of Patent: May 7, 1996

[54] TUBE ALIGNMENT STRAP

[75] Inventors: Gregory A. Burns, Newport News, Va.; Charles E. Cameron, Charlotte, N.C.; Richard S. Conrad, Richmond, Va.

[73] Assignee: The Babcock & Wilcox Company, New Orleans, La.

[21] Appl. No.: 369,626

[22] Filed: Jan. 6, 1995

[51] Int. Cl.[6] ..... F28F 9/00

[52] U.S. Cl. ..... 165/162; 122/511; 248/681

[58] Field of Search ..... 165/162; 122/511; 248/68.1

[56] References Cited

U.S. PATENT DOCUMENTS

| | | | |
|---|---|---|---|
| 2,198,529 | 4/1940 | Fields | 165/162 |
| 4,019,468 | 4/1977 | Miles | 165/162 |
| 4,088,184 | 5/1978 | Cavallaro | 165/162 |
| 5,016,706 | 5/1991 | Dimarco et al. | 165/162 |
| 5,052,474 | 10/1991 | Bronnert | 165/162 X |
| 5,136,985 | 8/1992 | Krowech | 165/162 |

FOREIGN PATENT DOCUMENTS

| | | | |
|---|---|---|---|
| 0299688 | 1/1989 | United Kingdom | 165/162 |

*Primary Examiner*—John Rivell
*Assistant Examiner*—Christopher Atkinson
*Attorney, Agent, or Firm*—Robert J. Edwards; D. Neil LaHaye

[57] ABSTRACT

A tube alignment strap for maintaining alignment and spacing between adjacent tubes in a superheater. A U-shaped strap receives a first tube in the U-shape of the strap. The open end of the strap is rigidly attached to pads provided on a second adjacent tube. A semi-circular collar has a bore at each end sized to receive the straight portions of the U-shaped strap such that the semi-circular collar is slidable over the U-shaped strap so as to be adjacent the first tube. The semi-circular collar is rigidly attached to the U-shaped strap.

2 Claims, 1 Drawing Sheet

TUBE ALIGNMENT STRAP

BACKGROUND OF THE INVENTION

1. Field of the Invention

The invention is generally related to the alignment and spacing of tubes in heat exchangers and more particularly to improved means for maintaining alignment and spacing between tubes.

2. General Background

In superheater units, tubes are heated to impart additional energy to the saturated vapor contained in the tubes. Temperature differentials in the stream of hot gases are a potentially significant cause of premature tube failure. Failures occur as a result of the differential expansion of the tube metal from tube-to-tube within a unit. Temperature differences cause the tubes to shift out of their original positions, producing stresses, metal fatigue, and tube misalignment. Tube misalignment leads to further increase in stress as well as erosion when tubes shift out of alignment into the path of hot gases. In superheaters, the heat exchange tubes are arranged parallel to each other and extend vertically through the superheater. One means of maintaining tube alignment has been through the use of tongue and groove ties. A tongue welded to one tube has a flange at one end that is received in a groove defined by two pieces welded to an adjacent tube. This type of arrangement presents problems of at least two types. One is that welding is required on both tubes. The second is that if the tongue or groove weld fails, metal is likely to be pulled from the tube. This weakens the tube and increases the likelihood of a tube leak.

SUMMARY OF THE INVENTION

The invention addresses the above need. What is provided is a tube alignment strap for maintaining alignment and spacing between adjacent tubes. A U-shaped strap receives a first tube in the U-shape of the strap. The open end of the strap is rigidly attached to pads provided on a second adjacent tube. A semi-circular collar has a bore at each end sized to receive the straight portions of the U-shaped strap such that the semicircular collar is slidable over the U-shaped strap so as to be adjacent the first tube. The semi-circular collar is rigidly attached to the U-shaped strap.

BRIEF DESCRIPTION OF THE DRAWINGS

For a further understanding of the nature and objects of the present invention reference should be had to the following description, taken in conjunction with the accompanying drawing in which like parts are given like reference numerals, and wherein.

DETAILED DESCRIPTION OF THE PREFERRED EMBODIMENT

Figure 1:
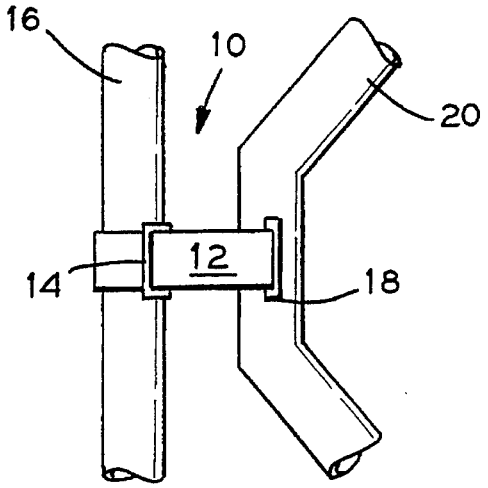
FIG. 1 is an elevation view of the invention.
Figure 2:
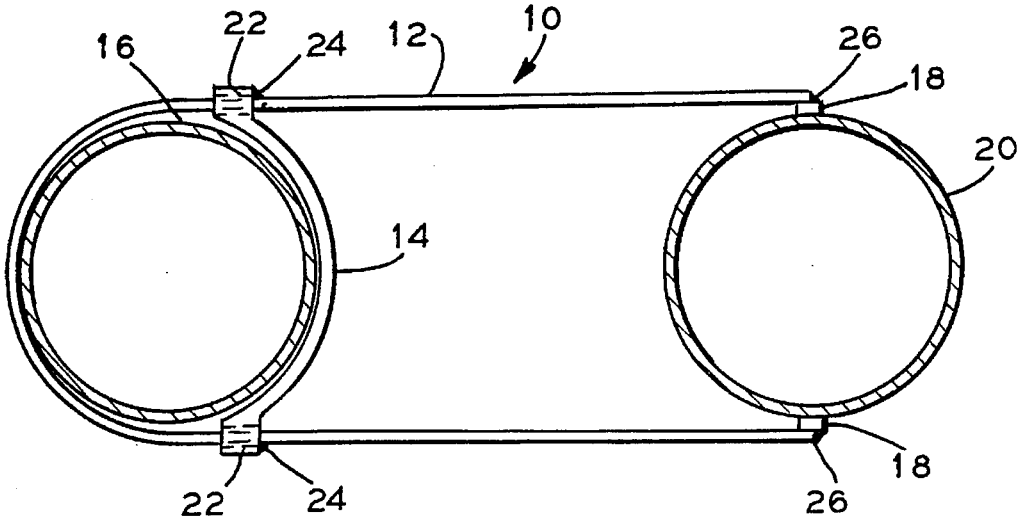
FIG. 2 is a top view of the invention.

Referring to the drawings, it is seen in FIG. 1 and 2 that the invention is generally indicated by the numeral 10. Tube alignment strap 10 is generally comprised of U-shaped strap 12 and semi-circular collar 14.

U-shaped strap 12 receives a first tube 16 in the U-shape of the strap. Semi-circular collar 14 is provided with a bore 22 at each end sized to slidably receive the straight portions of U-shaped strap 12 such that semi-circular collar 14 is slidable over U-shaped strap 12 so as to be adjacent first tube 16. Semi-circular collar 14 is rigidly attached to U-shaped strap 12 in position adjacent first tube 16 by any suitable means such as welding as indicated by numeral 24. The open end of strap 12 is rigidly attached to pads 18 provided on a second adjacent tube 20 by suitable means such as welding as indicated by numeral 26. As seen in FIG. 2, semi-circular collar 14 is not in contact with first tube 16, and in the preferred embodiment is spaced one-eighth inch from first tube 16 to allow for thermal expansion during normal operations.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. In a heat exchanger having a plurality of heat exchange tubes, a tube alignment strap for maintaining alignment and spacing between adjacent tubes, comprising:

a. a U-shaped strap, with one open end and straight side portions, that receives a first tube in the U-shape of the strap, the open end of the strap being rigidly attached to pads provided on a second adjacent tube; and b. a semi-circular collar having a bore at each end sized to receive the straight portions of said U-shaped strap such that said semi-circular collar is slidable over said U-shaped strap so as to be adjacent the first tube, said semi-circular collar being rigidly attached to said U-shaped strap.

2. The tube alignment strap of claim 1 wherein said semicircular collar is spaced apart from said first tube.

* * * * *